US009371846B2

(12) United States Patent
Van der Heide

(10) Patent No.: US 9,371,846 B2
(45) Date of Patent: Jun. 21, 2016

(54) TELESCOPIC HYDRAULIC CYLINDER

(71) Applicant: Hyva Holding BV, Alphen aan den Rijn (NL)

(72) Inventor: Rolf Van der Heide, Nieuwveen (NL)

(73) Assignee: HYVA HOLDING B.V., Alphen Aan Den Rijn (NL)

( * ) Notice: Subject to any disclaimer, the term of this patent is extended or adjusted under 35 U.S.C. 154(b) by 636 days.

(21) Appl. No.: 13/654,479

(22) Filed: Oct. 18, 2012

(65) Prior Publication Data

US 2013/0098241 A1 Apr. 25, 2013

(30) Foreign Application Priority Data

Oct. 20, 2011 (EP) ..... 11185968

(51) Int. Cl.
*F15B 15/16* (2006.01)
*F15B 15/14* (2006.01)

(52) U.S. Cl.
CPC ..... *F15B 15/16* (2013.01); *F15B 15/1471* (2013.01)

(58) Field of Classification Search
CPC ... F15B 15/16; F15B 15/1471; F15B 15/1423
USPC ..... 92/51, 52, 53
See application file for complete search history.

(56) References Cited

U.S. PATENT DOCUMENTS

| | | | | |
|---|---|---|---|---|
| 3,631,765 A | | 1/1972 | Neumeister | |
| 4,385,704 A | * | 5/1983 | Spain et al. | 212/350 |
| 4,575,976 A | * | 3/1986 | McDermott et al. | 52/118 |
| 4,848,524 A | | 7/1989 | Hosan et al. | |

FOREIGN PATENT DOCUMENTS

| | | | | |
|---|---|---|---|---|
| CN | 201443547 | | 4/2010 | |
| CN | 201443547 U | * | 4/2010 | F15B 15/16 |
| DE | 102011009365 A1 | * | 7/2012 | F15B 15/20 |
| EP | 2466156 | | 6/2012 | |

OTHER PUBLICATIONS

European Search Report, mailed Apr. 2, 2012 in connection with EP 11185968.2.
Abstract of CN 201443547.
European Extended Search Report, mailed Jan. 17, 2013 in connection with European Patent Application No. 12187007.5.

* cited by examiner

*Primary Examiner* — Nathaniel Wiehe
*Assistant Examiner* — Matthew Wiblin
(74) *Attorney, Agent, or Firm* — Steven M. Koehler; Westman, Champlin & Koehler, P.A.

(57) ABSTRACT

A telescopic hydraulic cylinder includes an inner cylindrical tube and an outer cylindrical tube located concentrically about the inner cylindrical tube, and a guide ring for guiding the inner and outer cylindrical tubes. The guide ring has a cylindrical support surface with a center line and a guide surface and is mounted in a cylindrical groove. The guide surface slides along the inner surface of the outer cylindrical tube or the outer surface of the inner cylindrical tube. The guide surface has a curved surface with a curve radius and a tangent and the tangent to the curved surface and the center line form an inclination angle between zero and five degrees, and the curve radius is larger than the radius of the guide ring in the plane perpendicular to the center line.

16 Claims, 4 Drawing Sheets

TELESCOPIC HYDRAULIC CYLINDER

PRIORITY CLAIM(S) AND/OR CROSS REFERENCE(S) TO RELATED APPLICATION(S)

This application is an original application under 35 U.S.C. §111(a) claiming priority to European Application No. 11185968.2, filed Oct. 20, 2011, whose application and publication are incorporated herein by reference and made a part hereof in its entirety, and the benefit of priority of which is claimed herein.

FIELD OF INVENTION

The present disclosure relates to a telescopic hydraulic cylinder.

SUMMARY

The present invention relates to a telescopic hydraulic cylinder, comprising an inner cylindrical tube and an outer cylindrical tube located concentrically around the inner cylindrical tube, and a guide ring for guiding the inner and outer cylindrical tubes while moving in longitudinal direction with respect to each other, the guide ring has a cylindrical support surface with a centre line and a guide surface and is mounted with its cylindrical support surface in a cylindrical groove in either the outer surface of the inner cylindrical tube or the inner surface of the outer cylindrical tube and the guide surface slides along the inner surface of the outer cylindrical tube or the outer surface of the inner cylindrical tube respectively.

Such a telescopic hydraulic cylinder is discussed in European patent application EP2466156, which was filed by the same applicant as the applicant of the present application.

It is an object of the present invention to provide a telescopic hydraulic cylinder, which has increased durability.

This is achieved by the telescopic hydraulic cylinder according to the disclosure, which is characterized in that the guide surface has in a plane that includes the centre line a curved surface with a curve radius an a tangent and the tangent to the curved surface and the centre line form a tangent angle; wherein the tangent angle is between zero and five degrees and possibly between zero and two degrees and the curve radius is larger than the radius of the guide ring in the plane perpendicular to the centre line. In this way in situations with small alignment faults between the inner cylindrical tube and the outer cylindrical tube the contact between the guide surface and the opposite inner cylindrical tube or outer cylindrical tube is between a cylindrical surface and a curved surface with a large curve radius instead of between a cylindrical surface and a sharp edge, so that high tension stress is avoided and a better durability of the guide ring and the cylindrical tube is achieved.

In an embodiment, the telescopic hydraulic cylinder is according to claim 2. In this way, the guide ring can have a fully curved guide surface or a large width, which reduces the contact stress between the guide ring and the inner or outer cylindrical tubes.

In an embodiment, the telescopic hydraulic cylinder is according to claim 3. In this way the surface stress on the guide ring is further reduced which improves the durability of the guide ring.

In an embodiment, the telescopic hydraulic cylinder is according to claim 4. In this way, the fillets prevent high loads on the ends of the guide ring.

In an embodiment, the telescopic hydraulic cylinder is according to claim 5. In this way, the oil in the hydraulic cylinder lubricates the sliding between the inner surface of the inner cylindrical tube or the surface of the outer cylindrical tube and the guiding surface of the guide ring.

In an embodiment, the telescopic hydraulic cylinder is according to claim 6. In this way, high stresses on the not lubricated surface of the wear ring are avoided.

The invention will hereafter be elucidated with reference to the schematic drawings showing an embodiment of the invention by way of example.

DETAILED DESCRIPTION

Figure 1:
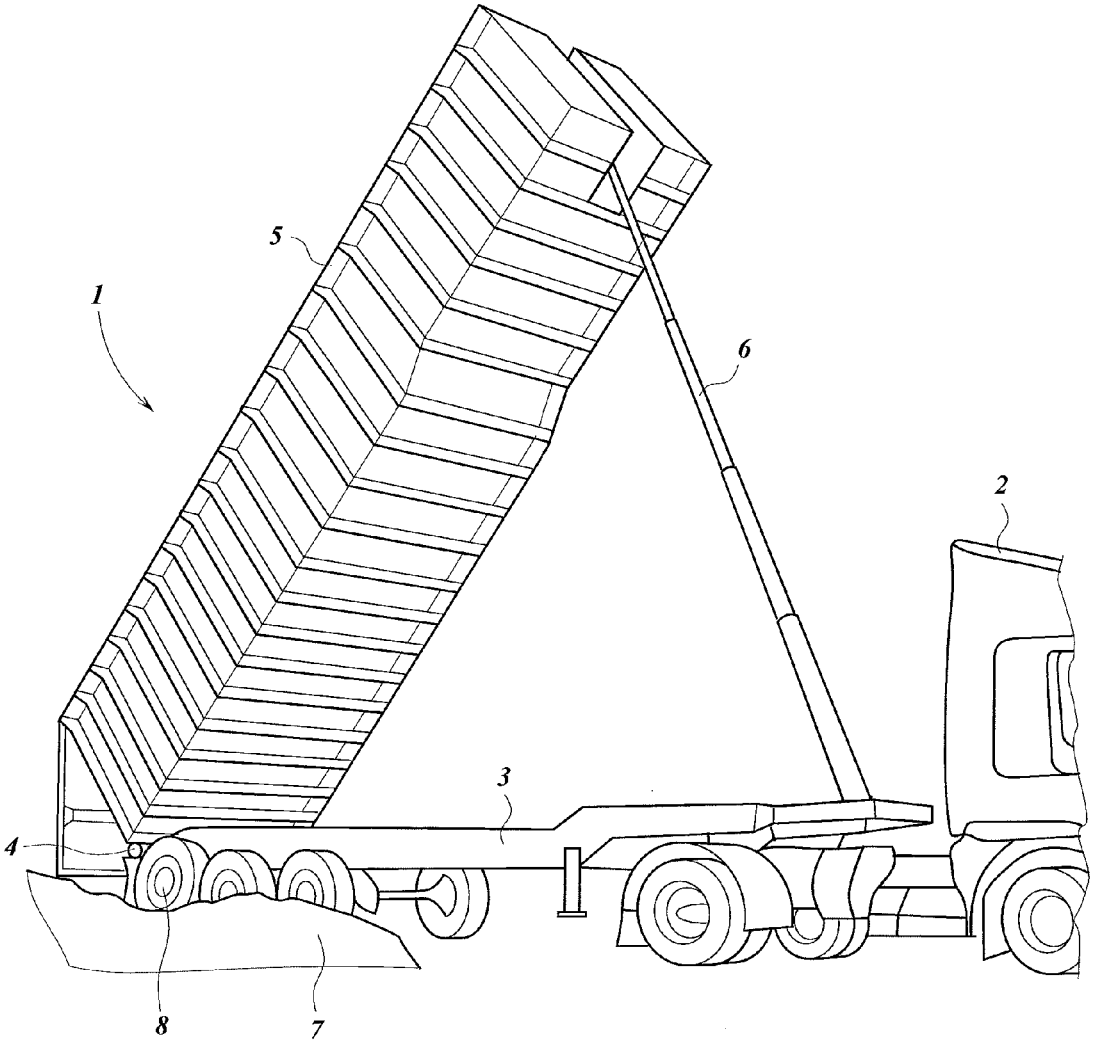
FIG. 1 is a perspective view of a tipper with a telescopic hydraulic cylinder lifting a tipping body.

FIG. 1 shows a tipper 1 comprising a tractor 2 and a trailer 3. A hinge 4 connects a frame of the trailer 3 and a tipping body 5 and a telescopic hydraulic cylinder 6 can lift the tipping body 5 to a tilted position for unloading the tipping body 5. The trailer 3 has axles with wheels to support the frame of the trailer 3 on the terrain. The terrain might have mounds 7, so that a rear axle 8 and with that the hinge 4 can be slightly inclined whereby the trailer 3 has a slight twist. The inclination of the hinge 4 can cause sideways movement of the tipping body 5 relative to the trailer 3 and in extreme situations this might lead to rolling over of the tipper 1 after the telescopic hydraulic cylinder 6 lifts the tipping body 5. By giving support to the tipping body 5 in a direction transverse to the trailer 3, the telescopic hydraulic cylinder 6 reduces the sideways movement to the tipping body 5 relative to the trailer 3 during tipping. For this, the telescopic hydraulic cylinder 6 can exert a transversal force on the tipping body 5.

Figure 2:
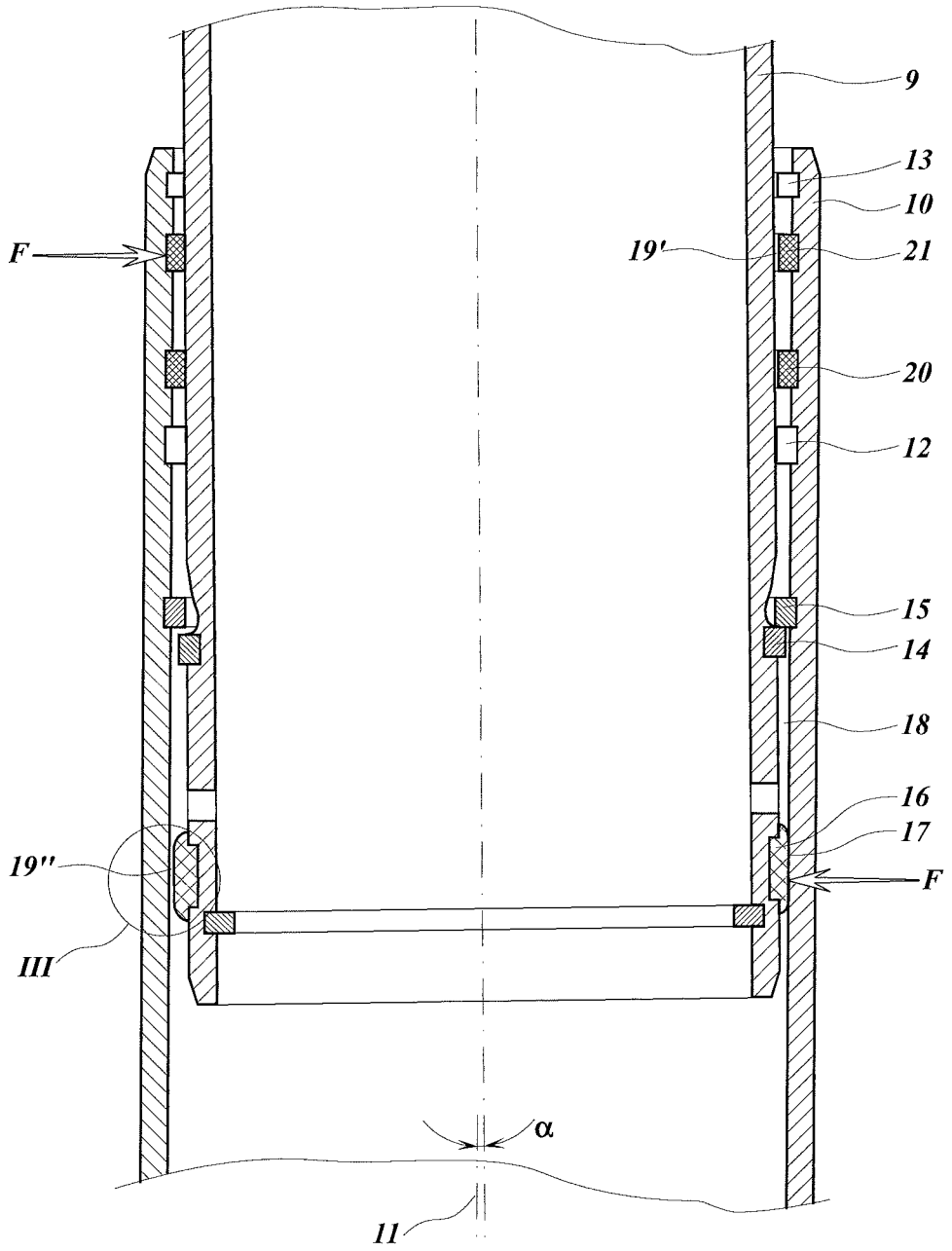
FIG. 2 is a detailed cross-sectional view through a centre line of a part of the telescopic hydraulic cylinder of FIG. 1, illustrating the transition between an inner cylindrical tube and an outer cylindrical tube in an extended position of the telescopic hydraulic cylinder.

FIG. 2 shows a part of the telescopic hydraulic cylinder 6 of FIG. 1, in particular the transition between an inner cylindrical tube 9 and an outer cylindrical tube 10. The telescopic hydraulic cylinder 6 is described in more detail in a European application of the same applicant with publication number EP 2466156. In FIG. 2, several parts of the telescopic hydraulic cylinder 6 are not shown, for example a piston, hydraulic channels and other tubes or cylinder elements.

The inner cylindrical tube 9 and the outer cylindrical tube 10 are each made of a pipe and located concentrically about around each other. Between the inner cylindrical tube 9 and the outer cylindrical tube 10 is a gap 18. Near the top end of an inner wall of the outer cylindrical tube 10 is a groove into which a seal 12 is mounted to seal the gap 18 from the surroundings. The seal 12 can slide over an outer wall of the inner cylindrical tube 9. Further to the top end of the inner wall of the outer cylindrical tube 10 is a groove into which a wiper 13 is mounted to remove contamination from the outer wall of the inner cylindrical tube 9 to prevent dirt from entering into the gap 18 and damaging the seal 12. An upper wear ring 21 and a lower wear ring 20 are mounted in grooves in the outer cylindrical tube 10 between the seal 12 and the wiper 13 at an end of the outer cylindrical tube 10 and support the outer cylindrical tube 10 on the outside surface of the inner cylindrical tube 9 so that the seal 12 is not compressed too far and remains flexible.

In the embodiment as shown, the inner cylindrical tube 9 is moveable with respect to the outer cylindrical tube 10 between a retracted condition and an extended condition. Under operating conditions, supplying hydraulic pressure to the telescopic hydraulic cylinder 6 moves the inner cylindrical tube 9 upwardly with respect to the outer cylindrical tube 10. FIG. 2 shows the extended condition. In this embodiment, the pair of stop rings 14, 15, which are mounted in grooves in the outer wall of the inner cylindrical tube 9 and the inner wall of the outer cylindrical tube 10 respectively, stop the upward movement of the inner cylindrical tube 9.

The upper wear ring 21 and the lower wear ring 20 that guide the axial movement of the inner cylindrical tube 9 within the outer cylindrical tube 10 are made from plastic material that has good sliding properties over the outer surface of the inner cylindrical tube 9, this is advantageous as they are outside of the gap 18 and there is no oil lubrication. The wear rings 20, 21 are mounted in grooves that are located near the top end of the outer cylindrical tube 10. In the shown embodiment there are two wear rings 20, 21. In other embodiments the number of wear rings can be different, for instance only one wear ring or up to six wear rings; other materials than plastic are also used.

A further guidance is by means of a guide ring 16; in an embodiment the guide ring 16 is from metal so that it maintains the width of the gap 18 over the full circumference, cannot be compressed and shows little wear. The guide ring 16 is located in the gap 18 between the inner and outer cylindrical tubes 9, 10 and mounted in a cylindrical groove in the outer wall of the inner cylindrical tube 9; the cylindrical groove has a centre line 11 which in general coincides with the centre line of the inner cylindrical tube 9 and with the centre line of the inner surface of the guide ring 16. A guide surface 17 of the guide ring 16 is slidable along the inner wall of the outer cylindrical tube 10 and the oil in the telescopic hydraulic cylinder 6 lubricates the sliding between the guide surface 17 and the inner wall of the outer cylindrical tube 10. In an embodiment, the guide ring 16 is from cast iron. At both ends of the guide ring 16 the guide surface 17 ends in a fillet towards the sides of the guide ring 16, so that there is a gradual end to the guide surface 17. In the shown embodiment the radius of the fillet is approximately the same as the width of the gap 18.

As described hereinbefore there may be a transverse load on the telescopic hydraulic cylinder 6 in addition to a buckling force during lifting the tipper body 5. Therefore, in the extended condition, the inner cylindrical tube 9 exerts a torque on the outer cylindrical tube 10; two force vectors F indicate this torque in FIG. 2 at the location of the upper wear ring 21 and the guide ring 16. The force F on the wear ring 21 removes the play at one side of the wear ring 21 and creates an aperture 19' at the other side of the wear ring 21. The force F on the guide ring 16 removes the play at one side of the guide ring 16 and creates an aperture 19" at the other side of the guide ring 16. The forces F also lead to deformation of the circular shape of the inner cylindrical tube 9 and the outer cylindrical tube 10 so that the round cross section deforms to a slightly elliptical cross section. The apertures 19' and 19" and the slight deformation lead to a misalignment angle $\alpha$ between the actual centre line of the inner cylindrical tube 9 and the actual centre line of the outer cylindrical tube 10; FIG. 2 shows this misalignment angle $\alpha$.

Figure 3:
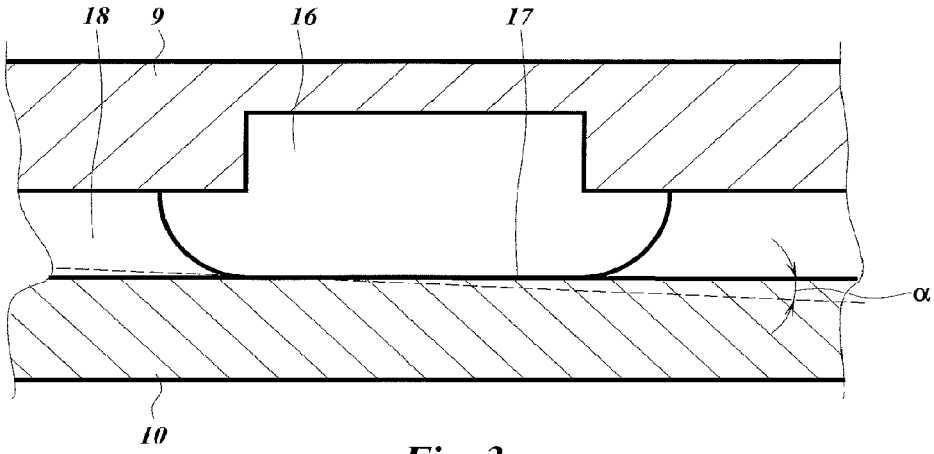
Fig. 3 (Prior Art)
FIG. 3 shows detail III of FIG. 2 according to the prior art.

This means that the centre line of the inner cylindrical tube 9 and the centre line of the outer cylindrical tube 10 are out of line, although the misalignment angle $\alpha$ is very small in practice, for example smaller than 0.5°. Under circumstance the misalignment angle $\alpha$ might reach a higher value such as 1.0° or possibly 1.5°. When the inner cylindrical tube 9 moves in longitudinal direction relative to the outer cylindrical tube 10 and the guide ring 16 exerts a force onto the inner wall of the outer cylindrical tube 10 whereby the angle $\alpha$ is larger than zero the load concentrates at one of the sides of the guide ring 16 if the guiding surface 17 of the guide ring 16 is cylindrical and parallel to the centreline of the inner cylindrical tube 9. FIG. 3 shows this situation with a guide ring 16 that has fillets at both sides. The fillets have a relatively small radius that is approximately equal to the width of the gap 18. The relatively small fillets lead to high surface stress between the guide ring 16 and the inner surface of the outer cylindrical element 10. This high stress might lead to damage and/or abrasive wear to the guide ring and/or the outer cylindrical tube 10.

Figure 4:
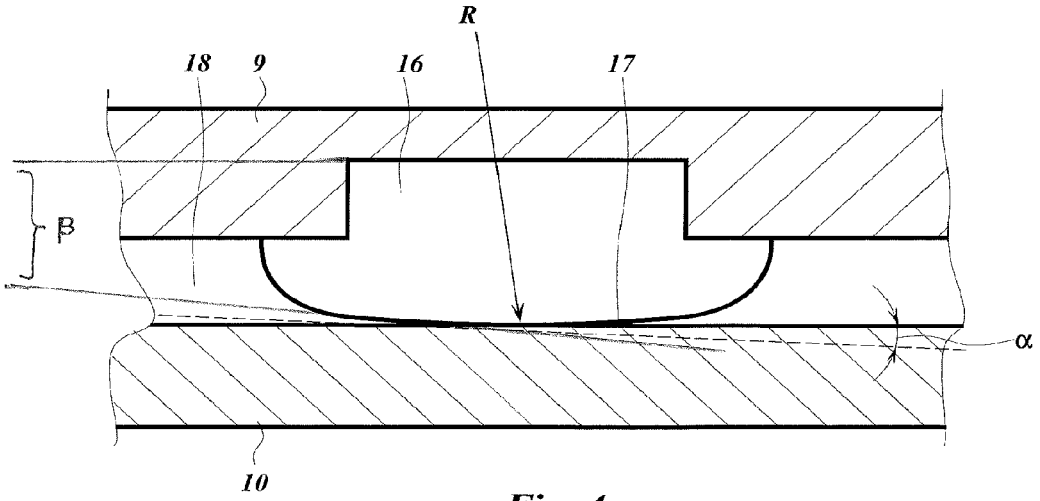
FIG. 4 shows detail III of FIG. 2 according to an embodiment of the invention.

In order to reduce or avoid abrasive wear of the guide ring 16 during sliding in the outer cylindrical tube 10 in the embodiment according to the invention the guide surface 17 is convex over a curved surface of the guide ring 16 in a direction parallel to its centre line 11 and has over this curved surface a radius R that is larger than the radius of the guide ring 16 in a plane perpendicular to the length of the tube. FIG. 4 shows the tangent t to the curved surface; the tangent t makes a tangent angle $\beta$ with the centre line 11 and the maximum value of the tangent angle $\beta$ is larger that the misalignment angle $\alpha$. In some embodiments the radius is larger than 0.10 m or larger than 0.20 m. As shown in the embodiment of the guide ring 16 in accordance with the invention, see FIG. 4, the guide ring 16 can have at both ends of the support width of the guide ring 16 a fillet for ease of mounting. The large radius R of the curved surface leads to a reduced surface stress and this avoids abrasive wear.

Figure 5:
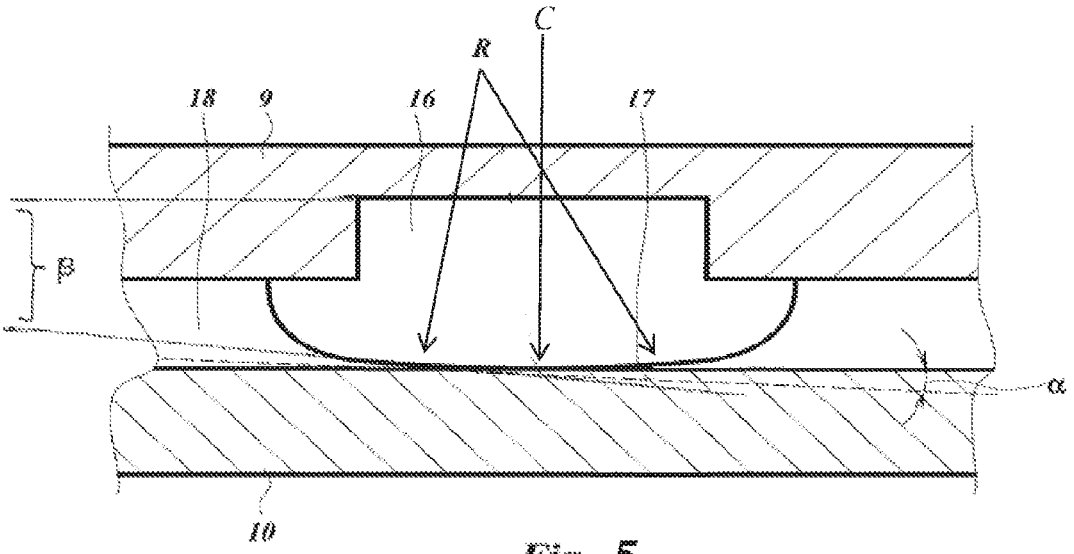
FIG. 5 shows detail III of FIG. 2 according to another embodiment of the invention.

It will be clear that the curved surface with the large radius R can be at both sides or ends of the guide ring 16 and can be adjacent to each other or the guide surface 17 is for a part cylindrical portion "C" and portions at both sides with the curved surfaces R as illustrated in FIG. 5.

In further embodiments, not shown, the guide ring 16 ends without fillet and has a rectangular cross section with a convex guide surface 17. In order to prevent high surface stress, the cross section of the guide ring 16 has a curve radius R that is at least the radius of the guide ring 16 in the plane of the cross section in that part of the guide surface 17 where the tangent t to the guide surface 17 makes a tangent angle $\beta$ that is at least 2 or possibly at least 5 degrees with the centre line 11 so that in case alignment faults with a misalignment angle $\alpha$ of upto 2 degrees or possibly upto 5 degrees the guide surface 17 contacts the opposite cylindrical surface with a sufficient large curve radius R.

Embodiment 1

Telescopic hydraulic cylinder (6), comprising an inner cylindrical tube (9) and an outer cylindrical tube (10) located concentrically around the inner cylindrical tube, and a guide ring (16) for guiding the inner and outer cylindrical tubes (9, 10) while moving in longitudinal direction with respect to each other, the guide ring (16) has a cylindrical support surface with a centre line (11) and a guide surface (17) and is mounted with its cylindrical support surface in a cylindrical groove in either the outer surface of the inner cylinder or the inner surface of the outer cylindrical tube and the guide surface slides along the inner surface of the outer cylindrical tube or the outer surface of the inner cylindrical tube respectively, wherein the guide surface (17) has in a plane that includes the centre line (11) a curved surface with a curve radius (R) and a tangent (t) and the tangent to the curved surface and the centre line form an tangent angle (β); wherein the tangent angle is between zero and five degrees and possibly between zero and two degrees and the curve radius (R) is larger than the radius of the guide ring (16) in the plane perpendicular to the centre line.

Embodiment 2

A telescopic hydraulic cylinder (6) according to embodiment 1 wherein the guide ring (16) has at each side a curved surface and the curved surfaces are adjacent or connected by a cylindrical surface.

Embodiment 3

A telescopic hydraulic cylinder (6) according to embodiment 1 or 2, wherein the curved radius (R) is at least 0.10 m or possibly at least 0.20 m.

Embodiment 4

A telescopic hydraulic cylinder (6) according to embodiment 1, 2 or 3, wherein the guide surface (17) has adjacent to the curved surface a fillet.

Embodiment 5

A telescopic hydraulic cylinder (6) according to embodiment 1, 2, 3 or 4, wherein a seal (12) seals an oil filled gap (18) between the inner cylindrical tube (9) and the outer cylindrical tube (10) and the guide ring (16) is located in the oil filled gap.

Embodiment 6

A telescopic hydraulic cylinder (6) according to embodiment 5, wherein a wear ring (20,21) is provided outside the oil filled gap (18) and the wear ring has a guide surface with a curved surface like the guide surface (17) of the guide ring (16) and the wear ring might be of plastic.

The invention is not limited to the embodiment shown in the drawings and described hereinbefore, which may be varied in different manners within the scope of the claims. It is, for example, conceivable that the guide ring 16 is fixed in the outer cylindrical tube 10 instead of the inner cylindrical tube 9 and/or that the wear rings 20,21 are also provided with convex guide surfaces.

The invention claimed is:

1. A telescopic hydraulic cylinder, comprising:

an inner cylindrical tube;

an outer cylindrical tube located concentrically around the inner cylindrical tube; and a guide ring for guiding the inner and outer cylindrical tubes while moving in longitudinal direction with respect to each other, wherein a first side of the guide ring has a cylindrical support surface with a center line and wherein a second opposing side of the guide ring has a guide surface, wherein the guide ring is mounted with its cylindrical support surface located in a cylindrical groove in either the outer surface of the inner cylinder or the inner surface of the outer cylindrical tube, and wherein the guide surface is configured to slide over the inner surface of the outer cylindrical tube or the outer surface of the inner cylindrical tube respectively;

wherein a cross-section of the guide surface in a plane that includes the center line comprises a curved profile which has a radius of curvature larger than a radius of the guide surface of the guide ring in a plane perpendicular to the center line; and wherein all tangent lines to the curved profile form a tangent angle with the center line of between zero and five degrees.

2. The telescopic hydraulic cylinder according to claim 1, wherein all tangent lines to the curved profile form a tangent angle with the center line of between zero and two degrees.

3. The telescopic hydraulic cylinder according to claim 1, wherein the radius of curvature of the curved profile is at least 0.10 m.

4. The telescopic hydraulic cylinder according to claim 1, wherein the radius of curvature of the curved profile is at least 0.20 m.

5. The telescopic hydraulic cylinder according to claim 1, wherein the guide surface has a fillet adjacent to the curved profile.

6. The telescopic hydraulic cylinder according to claim 1, further comprising a seal sealing an oil filled gap between the inner cylindrical tube and the outer cylindrical tube and wherein the guide ring is located in the oil filled gap.

7. The telescopic hydraulic cylinder according to claim 6, further comprising a wear ring provided outside the oil filled gap and wherein the wear ring has a guide surface with a curved profile matching the curved profile of the guide surface of the guide ring.

8. The telescopic hydraulic cylinder according to claim 7, wherein the wear ring is of plastic.

9. A telescopic hydraulic cylinder, comprising:

an inner cylindrical tube;

an outer cylindrical tube located concentrically around the inner cylindrical tube; and a guide ring for guiding the inner and outer cylindrical tubes while moving in longitudinal direction with respect to each other, wherein a first side of the guide ring has a cylindrical support surface with a center line and wherein a second opposing side of the guide ring has a guide surface, wherein the guide ring is mounted with its cylindrical support surface located in a cylindrical groove in either the outer surface of the inner cylinder or the inner surface of the outer cylindrical tube, and wherein the guide surface is configured to slides over the inner surface of the outer cylindrical tube or the outer surface of the inner cylindrical tube respectively;

wherein a cross-section of the guide surface in a plane that includes the center line comprises a linear profile center portion disposed between curved profile portions, each curved profile portion having a radius of curvature larger than a radius of the guide surface of the guide ring in a plane perpendicular to the center line; and wherein all tangent lines to the curved profile portions form a tangent angle with the center line of between zero and five degrees.

10. The telescopic hydraulic cylinder according to claim 9, wherein the radius of curvature of each curved profile portion is at least 0.10 m.

11. The telescopic hydraulic cylinder according to claim 9, wherein the radius of curvature of each curved profile portion is at least 0.20 m.

12. The telescopic hydraulic cylinder according to claim 9, wherein the guide surface has a fillet adjacent to each curved profile on a side opposite the linear profile center portion.

13. The telescopic hydraulic cylinder according to claim 12, further comprising a seal sealing an oil filled gap between the inner cylindrical tube and the outer cylindrical tube and wherein the guide ring is located in the oil filled gap.

14. The telescopic hydraulic cylinder according to claim 13, further comprising a wear ring provided outside the oil filled gap and wherein the wear ring has a guide surface with a curved profile matching the curved profiles portions of the guide surface of the guide ring.

15. The telescopic hydraulic cylinder according to claim 14, wherein the wear ring is of plastic.

16. The telescopic hydraulic cylinder according to claim 9, wherein all tangent lines to each curved profile portions form a tangent angle with the center line of between zero and two degrees.

* * * * *